United States Patent [19]

Simpson

[11] 4,017,122

[45] Apr. 12, 1977

[54] LONGWALL TRENCH MINING SYSTEM

[75] Inventor: Peter Joseph Simpson, Niagara Falls, Canada

[73] Assignee: Acres Consulting Services Limited, Toronto, Canada

[22] Filed: June 23, 1976

[21] Appl. No.: 698,878

[52] U.S. Cl. ..... 299/11; 299/18; 299/19

[51] Int. Cl.[2] ..... E21C 41/00

[58] Field of Search ..... 299/11, 18, 19

[56] References Cited

UNITED STATES PATENTS

| | | | |
|---|---|---|---|
| 3,301,599 | 1/1967 | Heimaster | 299/18 |
| 3,467,435 | 9/1969 | Mallander | 299/18 X |
| 3,799,613 | 3/1974 | Hendry | 299/18 X |

*Primary Examiner*—Ernest R. Purser
*Attorney, Agent, or Firm*—Finnegan, Henderson, Farabow & Garrett

[57] ABSTRACT

Disclosed is a method for mining minerals at depths where strip and deep mining methods are not practical or economical. After site layout, a plurality of generally parallel-spaced, elongated trenches are formed to expose the mineral bed. Continuous mining equipment is used to mine the minerals from the base of the trench. A conveyor is disposed in each trench to convey the mined minerals to one end of the site to a collection conveyor. After the minerals are mined from the base of the trench, mining tunnels are formed to the opposite sides of and generally perpendicular to each trench and adjacent one end thereof. The tunnels are extended distances at least several times the width of the trench and thereby form longwall mining surfaces. Longwall mining equipment is disposed in each tunnel and the minerals are mined by advancing the longwall mining equipment in a direction parallel to the trench and toward its opposite end. As the longwall mining equipment advances, the overburden caves behind the equipment. The minerals mined from the tunnels are conveyed to the trench conveyor and then lengthwise along the trench to the collection conveyor. After the longwall equipment has advanced the length of each trench completing the underground mining operation, the equipment is withdrawn, the trench is backfilled, and the surface is restored.

21 Claims, 5 Drawing Figures

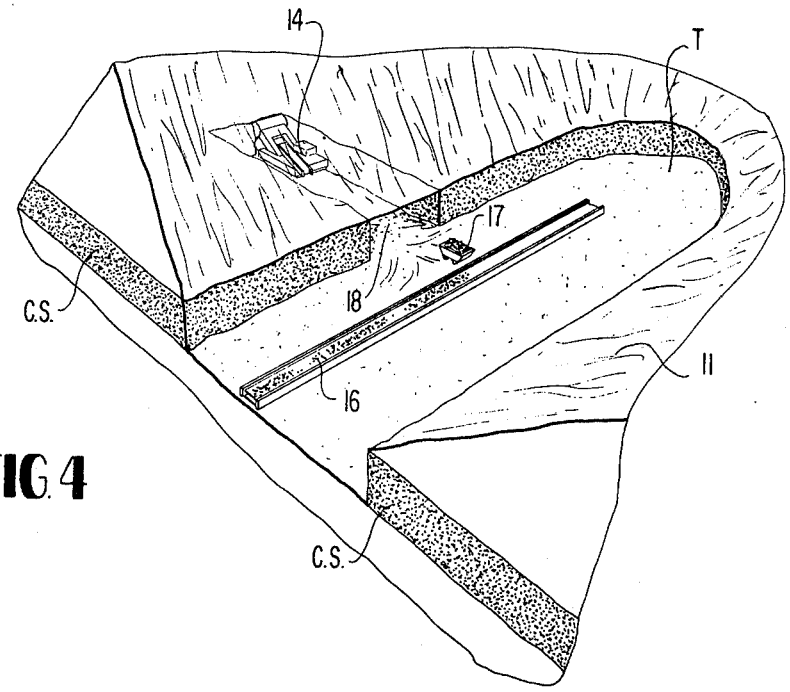
FIG. 4
FIG. 5
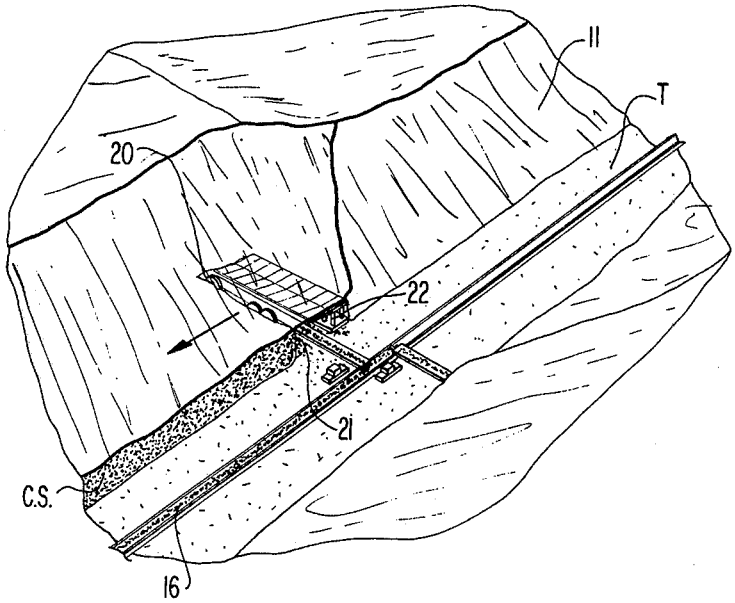

LONGWALL TRENCH MINING SYSTEM

The present invention relates to methods for mining minerals and particularly relates to a longwall/trench system for mining coal.

Traditionally, coal mining has been conducted by either strip mining or deep mining methods. For low grade thermal coals, strip mining is seldom economical if the overburden is excessive. Conventional open pit mining methods are usually economical only if the overburden does not exceed a ratio of about 20:1 overburden to coal. On the other hand, deep mining requires extensive support structures and elaborate ventilation systems. Deep mining is thus costly and usually economically feasible only for extraction of high quality coal reserves.

Considerable coal reserves are known to exist which, due to their depth and/or quality, would be uneconomical to exploit by conventional methods. The present invention provides a novel and unique system for the recovery of these reserves.

The present coal mining system is particularly useful is certain geographical areas and under certain geological conditions. For example, the mining system of the present invention is particularly adapted for mining coal seams which range from about 4–12 feet in thickness. Under optimum conditions, the seams should extend substantially horizontal. Seams which incline and undulate, for example with grades up to and including 15°, may be mined utilizing the mining system of this invention. Further, it is preferable that the mineral bed or coal seam have overlying bed-rock of substantial thickness, for example on the order of about twice the thickness of the coal seam, which separates the coal seam from the overburden. This, as will become clear from the ensuing description, enables effective use of rock bolts and self advancing roof supports in the present coal mining system. Thus, the present invention is ideally suited for certain geographical locations and geological conditions and affords a novel and unique system which renders coal mining practical and economical in areas and under conditions where strip mining or deep mining methods would not otherwise be practical or economical.

More particularly, the present invention is characterized by the formation of a plurality of elongated, substantially parallel, trenches which extend the full length of the mining site. Preferably, the trenches are about 600 yards apart. To form the trenches, the overburden and bed-rock are excavated to the top surface of the mineral bed. The slope of the side walls of the trenches should be as steep as possible to minimize overburden removal and thus reduce costs. The slope of these side walls, however, should be sufficiently gradual to ensure adequate static and dynamic stability. The slope is, of course, dependent upon the geological conditions at the mining site. At one end of the trenches, a collection conveyor is installed and which conveyor extends transversely of the mining site between the end trenches.

Once the trenches are excavated to the top surface of the coal seam, the portion of the coal seam within the lateral confines of the trench and preferably along the centerline of the base of the trench cut or mined. Conventional continuous mining equipment is utilized for this purpose and this mined coal is temporarily stockpiled on both sides of the trench on top of the remaining portion of the exposed coal seam within the trench. A conveyor system is then installed in the base of this cut and connected to the collection conveyor at one end of the coal site. The remaining coal in the base of the trench is then mined by the continuous mining equipment and loaded onto the trench conveyor for transport to the collection conveyor.

Once the coal seam at the base of each trench is removed, a heading or tunnel is cut into the coal seam to both sides of the trench and in a direction substantially normal to the direction of the trench. Preferably continuous mining equipment is used to form these headings and the coal mined from the seam in each heading is shuttled to the trench conveyor for transport to the collection conveyor. Each heading is formed in the coal seam beneath the overburden substantially at right angles to the trench and for a significant distance from the trench base, for example on the order of 300 yards to either side of the trench. Preferably, rock bolts are used to support the roof in each heading. Auxiliary fans and tubing will be used to ventilate the headings and subsequent longwall faces.

When these initial headings are completed, it will be appreciated that a longwall surface is provided in each heading along each side of each trench and at one end of the trench system. These longwall surfaces can thus be mined in a direction generally parallel to the trench. To accomplish this, longwall mining equipment is installed in the initially formed headers or mining tunnels. The coal is then mined, for example by shearing it from each exposed longwall surface. The mined coal is then conveyed along each tunnel to the trench conveyor for transport to the collection conveyor.

The longwall mining equipment, which includes self-advancing roof supports, advances in a direction generally parallel to the trenches. As this equipment advances, the unsupported overburden behind the longwall mining equipment is allowed to cave behind the self-advancing roof supports. It will be appreciated that this operation is performed substantially automatically under control from locations in the trench.

When the entire coal seam within the lateral reach of the longwall mining equipment operated from each trench has been mined by advancement of the equipment the full length of the trench system toward its opposite end, the roofs of the final mining tunnels are temporarily supported by rockbolts. The longwall mining equipment is then withdrawn to the trench and removed. The trench is then backfilled and the surface is restored and replanted.

Accordingly, it is a primary object of the present invention to provide a novel and improved method for mining minerals.

It is another object of the present invention to provide a novel and improved method for mining minerals at depths where conventional surface mining and deep mining methods are impractical and/or uneconomical.

It is still another object of the present invention to provide a novel and improved method of mining minerals which minimizes removal of the over-burden.

It is a further object of the present invention to provide a novel and improved method of mining minerals which eliminates the need for elaborate ventilation, haulage and supply systems normally associated with deep mining methods.

It is a still further object of the present invention to provide a novel and improved method of mining minerals which is highly economical, particularly through utilization of remote control and automatic systems to reduce manpower requirements.

It is a related object of the present invention to provide a novel and improved method of mining minerals which is particularly useful where the mineral bed is located generally between 60 and 240 feet below ground surface.

To achieve the foregoing objects and in accordance with the purpose of the present invention, as embodied and broadly described herein, a method of mining minerals according to this invention includes forming an elongated trench to the depth of the mineral bed, the trench having a predetermined width; mining the minerals from the mineral bed within the lateral confines of the trench; providing a mining tunnel through the mineral bed to one side of and substantially perpendicular to the trench for a distance at least several times the width of the trench at its base to form a long wall surface; providing longwall mining equipment in the mining tunnel; mining the longwall surface by utilizing the longwall mining equipment; advancing the longwall mining equipment in a direction generally parallel to the trench to mine the minerals of the mineral bed; and removing the mined minerals.

Preferably, a portion of the mineral bed narrower than the width of the trench at its base is initially excavated. The conveying equipment is then installed along this initially excavated portion, and the remaining portion of the minerals of the mineral bed within the lateral confines of the trench are mined and conveyed along the trench conveyor. Also, it is preferred that a second mining tunnel be provided to the opposite side of the trench from the first mining tunnel. Thus, longwall mining equipment may be provided in the second mining tunnel and advanced to mine its longwall surface simultaneously as longwall mining equipment in the first tunnel mines the coal seam and is advanced.

These and further objects and advantages of the present invention will become more apparent upon reference to the following specification, and drawings which disclose one embodiment of the present invention and serve to explain its principles.

IN THE DRAWINGS

FIG. 4 is a perspective view illustrating use of a continuous miner to form the initial longwall surfaces; and FIG. 5 is a perspective view similar to FIG. 4 illustrating use of longwall mining equipment in the disclosed embodiment of the mining method of the present invention.

Figure 1:
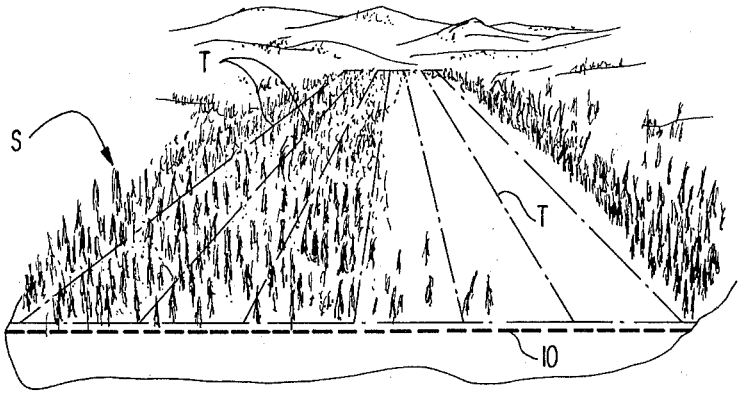
FIG. 1 is a perspective view of a mining site laid out for practising a method of mining minerals in accordance with the present invention.
Figure 2:
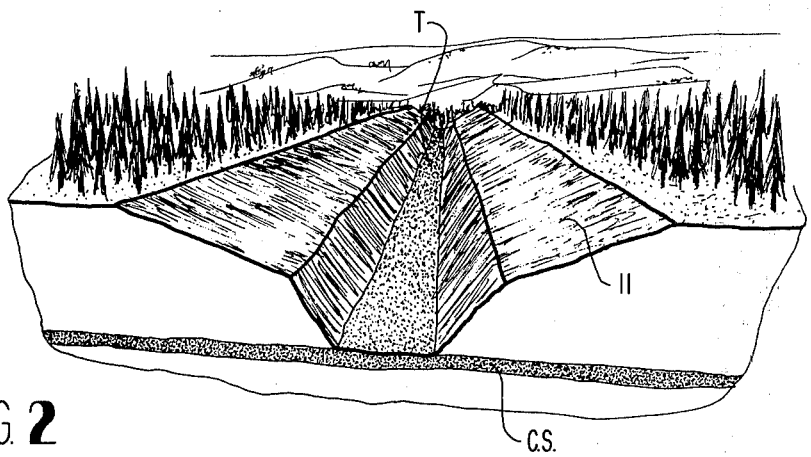
FIG. 2 is an enlarged view of an initial trench forming phase of a preferred mining method in accordance with the present invention.

Referring now to the drawings, particularly to FIG. 1, there is illustrated a site in which the novel and improved method of mining of the present invention may be utilized. For optimum technical and economic feasibility in utilizing the method of mining in accordance with the present invention, the site selected should have mineral seams on the order of 4 to 12 feet thick and which extend substantially horizontal with but slight grades or undulations. Mineral seam grades no steeper than about 15° are preferable. Also, the mineral seam and overburden should preferably be separated by bed rock of approximately twice the depth of the coal seam to ensure effective use of roof supports as amplified hereinafter. Economically, it is preferable that the overburden does not exceed 160 feet in depth although overburden ranges within 60–240 feet do not limit the effective economic use of the method of mining according to the present invention.

Under these preferable conditions, the mining site S illustrated in FIG. 1 is laid out. Particularly, the site is divided into a plurality of spaced, substantially parallel, trenches, generally designated T, and which trenches extend the full length of the selected mining site. Optimum location of the trenches requires due consideration of the terrain, geological conditions, optimum use of conveyors, support equipment and excavating equipment. Preferably, the trenches are spaced approximately 600 yards one from the other. Also, a collection conveyor, generally designated 10, is installed at one end of the site layout to transport the mined coal, as amplified hereinafter, from the trenches to a loading point or stockpile, not shown.

After site layout is completed and the collection conveyor 10 installed, the trenches T are excavated to expose the upper surface of the mineral seam, in this case a coal seam generally designated C.S. Excavation is, of course, accomplished using conventional equipment and the overburden and bed-rock are removed to the top surface of the coal seam. Each trench should be excavated such that it is approximately 20 yards wide at the mineral seam although this can be varied depending upon local conditions and preferences. The opposing walls 11 defining each trench are formed and graded sufficiently gradual to ensure stability of the overburden. These walls should, however, be sufficiently steep to minimize overburden removal and thereby reduce costs. The geological considerations which establish the static and dynamic stability of the slopes of the walls are, of course, dependent upon the particular site and its geology. It will be appreciated that the excavated overburden can be stockpiled adjacent the trenches to facilitate back-filling the trenches after mining is completed.

While the following description refers to mining operations performed in a single trench, it will be appreciated that the description is applicable to each of the plural trenches formed at the site S and that the mining method hereof contemplates substantially simultaneous mining of a plurality of trenches at site S up to and including simultaneous mining of all trenches T at site S. Also, it is within the scope of the present invention to mine each trench or a specified number of trenches in accordance with the following description in sequence as desirable.

Figure 3:
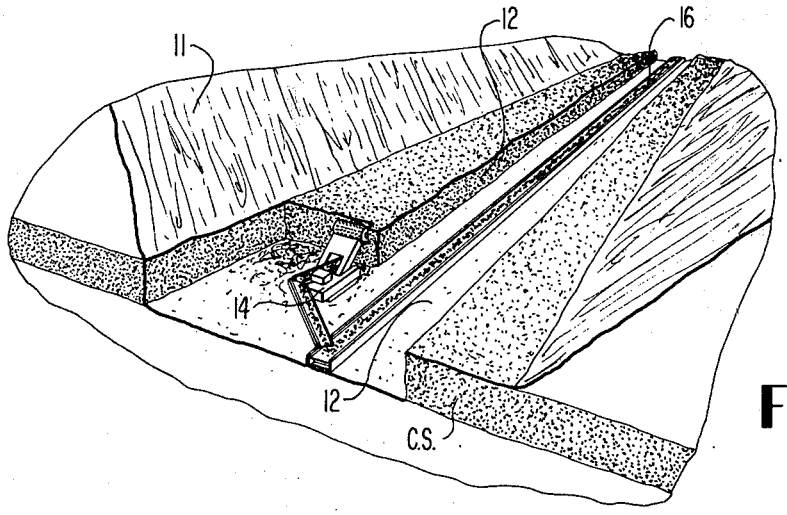
FIG. 3 is an enlarged perspective view illustrating the formation of the trench in the mineral bed preparatory to the longwall mining stage of the disclosed and preferred embodiment of the mining method hereof.

Referring now to FIG. 3, the method for mining the mineral bed within trench T will now be described. To accomplish this, an initial portion of the coal seam is mined along the centerline of the trench base to form an initial trough 12 which extends the full length of the trench. A continuous miner designated 14 may be used for this purpose and the mined coal may be stockpiled on top of the coal seam exposed in the base of the trench to either or both sides of the trough 12. After trough 12 is formed the full length of trench T, a conveyor system 16 (FIG. 3) is installed in trough 12 at the base of the coal seam and connected to the collection conveyor 10. The continuous miner 14 then completes the mining of the coal seam at the base of trench T on both sides of trough 12 to the full width of the trench base. The coal initially removed from trough 12 and stockpiled on top of the seam at the base of the trench as well as the coal mined from opposite sides of trough 12 is disposed on conveyor 16 for transport to collection conveyor 10 for stockpiling or to a loading area for further transport. Once the coal seam at the base of the trench is completely mined, the underground mining phase of the method hereof is commenced and this phase will now be described.

At the end of each trench, preferably remote from the collection conveyor, mining tunnels or headers are initially excavated prefereably to opposite sides of each trench T. Particularly, mining tunnels are formed by using continuous mining equipment to cut a heading into each side of the trench. The headings are formed in the coal seam and form tunnels generally extending at right angles to the trench. In forming the headings, the continuous miner mines the coal in the seam and such coal is removed by shuttle cars 17 to the trench conveyor 16 for subsequent transport to the collection conveyor 10. This is best illustrated in FIG. 4 which shows a continuous miner 14 cutting a header or starter tunnel 18 to one side of trench T and at the end thereof remote from collection conveyor 10. It will be appreciated that the continuous miner is also utilized to cut a similar header to the opposite side of trench T. Supports are provided in the headings. Generally a matrix of rock bolts is sufficient and grouting is not necessary in view of the temporary nature of the support.

Once these headers or starting tunnels 18 are completed and extend generally normal to trench T along its opposite sides for a distance on the order of about 300 yards, longwall mining equipment is installed. As those familiar with longwall mining equipment will appreciate, such equipment includes one or more shearers 20 (FIG. 5) which ride on a conveyor extending parallel to the face 21 of the long wall. Behind shearers 20 are located a plurality of self-advancing hydraulic roof supports 22. In operation, the shearer or shearers of the longwall mining equipment move back and forth along the exposed long face of the coal seam in the tunnel and mine the coal therefrom. This coal is transported by a conveyor associated with the longwall mining equipment to the trench conveyor 16 which conveys the mined coal to the collection conveyor 10 at the end of the mining site. The longwall mining equipment is preferably remotely operated from the trench thereby eliminating the need for an elaborate ventilation system or permanent roof supports.

As the shearers move back and forth along the length of the long wall surface 21 which extends substantially normal to the trench and mines coal from the longwall surface, it will be appreciated that the longwall mining equipment advances in a direction parallel to trench T toward the collection conveyor 16 at the end of the site. This mining direction is indicated by the arrow in FIG. 5. As the longwall mining equipment including the self-advancing roof supports progress in a direction parallel to the trench and the coal seam is removed, the trailing unsupported overburden is allowed to cave behind supports 22. During this progression toward the collection conveyor 10, the trench conveyor 16 may be removed in stages as the work proceeds along trench T in the direction of the arrow in FIG. 5.

Finally, the longwall mining equipment and supports therefor are advanced along each of the opposite sides of the trench a distance substantially equal to the length of the trench thus mining the coal seam which extends approximately 300 yards to the opposite sides of the trench and for its full length. At the end of such mining, the longwall tunnels extending at right angles to the trench are rock-bolted to enable removal of the longwall mining equipment without caving the final tunnels 18. Once the mining equipment and conveyors are removed from the trench, the trench is back-filled and the surface is smoothed, replanted and reseeded.

It will be appreciated that during the longwall underground mining phase of the present mining method, the longwall mining equipment may be utilized first to mine the coal seam to one side of the trench and thereafter used to mine the coal seam to the opposite side of the trench. Alternately, longwall mining equipment can be located in each starter tunnel and the mining may progress substantially simultaneously along opposite sides of each trench.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A method of mining minerals from a bed located below ground comprising:

forming an elongated trench of predetermined width to the depth of the mineral bed, mining the minerals from the mineral bed within the lateral confines of the trench, providing a mining tunnel through the mineral bed to one side of and substantially perpendicular to the trench for a distance at least several times the width of the trench at its base to form a long wall surface, providing longwall mining equipment in the mining tunnel, mining minerals from the longwall surface by utilizing the longwall mining equipment, advancing the longwall mining equipment in a direction generally parallel to the trench to mine the minerals of the mineral bed, and removing the mined minerals.

2. A method according to claim 1 including initially excavating a portion of the mineral bed at the base of the trench narrower than the width of the trench at its base, installing conveying equipment along said excavated portion, mining minerals from the remaining portion of the mineral bed within the lateral confines of the trench, and conveying the latter mined minerals along said conveyor.

3. A method according to claim 1 including installing a conveyor along the trench, conveying the minerals mined from the mining tunnel to the conveyor, and conveying the latter mined minerals along the trench.

4. A method according to claim 1 including allowing the overburden to cave behind the longwall mining equipment as the latter is advanced.

5. A method according to claim 1 including filling the trench after mining is completed.

6. A method according to claim 1 including initially excavating a portion of the mineral bed at the base of the trench narrower than the width of the trench at its base, installing conveying equipment along said excavated portion, mining minerals from the remaining portion of the mineral bed within the lateral confines of the trench, conveying the latter mined minerals along said conveyor, and conveying the minerals mined from the longwall face along the tunnel to the trench and along the trench.

7. A method according to claim 1 including installing supports for the roof of the mining tunnel to enable initial installation of the longwall mining equipment.

8. A method according to claim 1 including initially providing the mining tunnel adjacent one end of the trench, advancing the longwall mining equipment in a direction generally parallel to the trench to a location closely adjacent the opposite end of the trench, said longwall mining equipment forming a continuously advancing mining tunnel as it is advanced toward the opposite end of the trench, and allowing the overburden to cave behind the longwall mining equipment as it is advanced.

9. A method according to claim 8 including installing supports for the roof of the mining tunnel at the opposite end of the trench to enable removal of the longwall mining equipment.

10. A method according to claim 9 including installing supports for the roof of the mining tunnel to enable initial installation of the longwall mining equipment.

11. A method according to claim 1 including providing a second mining tunnel through the mineral bed to the opposite side of and substantially perpendicular to the trench for a distance at least several times the width of the trench at its base to form a long wall surface, providing longwall mining equipment in said second mining tunnel, mining minerals from the longwall surface thereof by utilizing the longwall mining equipment, advancing the latter longwall mining equipment in a direction generally parallel to the trench to mine the minerals of said mineral bed, and removing the latter mined minerals.

12. A method according to claim 11 including installing a conveyor along the trench, conveying the minerals mined by the longwall mining equipment in the tunnels to the conveyor, and conveying the minerals mined from the longwall surfaces of the first and second tunnels along the trench.

13. A method according to claim 12 including initially excavating a portion of the mineral bed at the base of the trench narrower than the width of the trench at its base, installing conveying equipment along said excavated portion, mining minerals from the remaining portion of the mineral bed within the lateral confines of the trench and conveying the latter mined minerals along said conveyor.

14. A method according to claim 12 including installing supports for the roof of each mining tunnel to enable installation of the longwall mining equipment in each tunnel.

15. A method according to claim 12 including initially providing each mining tunnel adjacent one end of the trench, advancing the longwall mining equipment in a direction generally parallel to the trench to locations adjacent the opposite end of the trench, the longwall mining equipment forming continuously advancing first and second mining tunnels, and allowing the overburden to cave behind the longwall mining equipment during its advance.

16. A method according to claim 15 including installing supports for each roof of the mining tunnels at the opposite end of the trench to enable removal of the longwall mining equipment from the tunnels.

17. A method according to claim 16 including installing supports for each roof of the mining tunnels to enable initial installation of the longwall mining equipment in the tunnels.

18. A method according to claim 1 including forming a second elongated trench of predetermined width to the depth of the mineral bed and in substantially parallel spaced relation to the first mentioned trench, mining the minerals from the mineral bed within the lateral confines of said second trench, providing a mining tunnel through the mineral bed to one side of and substantially perpendicular to the second trench for a distance at least several times the width of the second trench at its base to form a long wall surface, providing longwall mining equipment in the last mentioned mining tunnel, mining minerals from the longwall surface by utilizing the last mentioned longwall mining equipment, advancing the last mentioned longwall mining equipment in a direction generally parallel to the second trench to mine the minerals of the mineral bed, and removing the latter mined minerals.

19. A method according to claim 12 including forming a second elongated trench of predetermined width to the depth of the mineral bed and in a direction parallel to but spaced from the first mentioned trench, mining the minerals from the mineral bed within the lateral confines of the second trench, providing third and fourth mining tunnels through the mineral bed to the opposite sides of and substantially perpendicular to the second trench with each third and fourth tunnel extending a distance at least several times the width of the trench at its base to form a pair of long wall surfaces, respectively, providing longwall mining equipment in the third and fourth mining tunnels respectively, mining the longwall surfaces of the third and fourth tunnels by utilizing the longwall mining equipment therein, advancing the longwall mining equipment in the third and fourth tunnels in a direction generally parallel to the trenches to mine the minerals of the mineral bed, removing the minerals mined from the respective third and fourth longwall surfaces, installing a conveyor along the second trench, conveying the minerals mined by the longwall mining equipment in the third and fourth tunnels to the conveyor in the second trench, and conveying the minerals mined from the third and fourth longwall surfaces of the third and fourth tunnels respectively along the second trench.

20. A method of mining minerals from a bed located below the ground comprising:

forming a plurality of generally parallel laterally spaced elongated trenches to the depth of the mineral bed, each of said trenches having a predetermined width, mining the minerals from the mineral bed within the lateral confines of each trench, providing a mining tunnel through the mineral bed to one side of the substantially perpendicular to each trench for a distance at least several times the width of the trench at its base to form a long wall surface, providing longwall mining equipment in the mining tunnels, mining minerals from the longwall surfaces by utilizing the longwall mining equipment, advancing the longwall mining equipment in a direction generally parallel to the trenches to mine the minerals of the mineral bed, and removing the mined minerals.

21. A method according to claim 20 including providing a collection conveyor adjacent one end of the trenches to transport the minerals conveyed along the trenches to a collection station.

* * * * *

UNITED STATES PATENT AND TRADEMARK OFFICE

CERTIFICATE OF CORRECTION

PATENT NO. : 4,017,122

DATED : April 12, 1977

INVENTOR(S) : PETER JOSEPH SIMPSON

It is certified that error appears in the above-identified patent and that said Letters Patent are hereby corrected as shown below:

Claim 20

Column 8, line 62, change "the" to --and--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*